US009336966B2

(12) United States Patent
Halama et al.

(10) Patent No.: US 9,336,966 B2
(45) Date of Patent: May 10, 2016

(54) INDICATOR LAMP

(71) Applicant: Siemens Aktiengesellschaft, Munich (DE)

(72) Inventors: Jindrich Halama, Trutnov (CZ); Vit Ledl, Liberec (CZ); Radek Melich, Lisny (CZ); Jiri Varak, Radvanice (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/417,816

(22) PCT Filed: Nov. 20, 2012

(86) PCT No.: PCT/EP2012/073111

§ 371 (c)(1),
(2) Date: Jan. 28, 2015

(87) PCT Pub. No.: WO2014/079481

PCT Pub. Date: May 30, 2014

(65) Prior Publication Data

US 2015/0255230 A1 Sep. 10, 2015

(51) Int. Cl.
*F21V 5/00* (2015.01)
*H01H 13/02* (2006.01)
(Continued)

(52) U.S. Cl.
CPC ..... *H01H 13/023* (2013.01); *F21V 5/008* (2013.01); *F21V 13/04* (2013.01); *F21W 2111/00* (2013.01); *H01H 2219/036* (2013.01); *H01H 2219/06* (2013.01); *H01H 2219/066* (2013.01)

(58) Field of Classification Search
CPC ..... F21V 5/008; F21V 13/04; H01H 13/023; H01H 2219/066; H01H 2219/036; H01H 2219/06; F21W 2111/00
See application file for complete search history.

(56) References Cited

U.S. PATENT DOCUMENTS 3,228,288 A 1/1966 Marien
3,364,350 A * 1/1968 Larson ..... B60Q 3/044 340/815.47

(Continued)

FOREIGN PATENT DOCUMENTS

WO WO 2006099732 A1 9/2006
WO WO 2007135610 A1 11/2007

(Continued)

OTHER PUBLICATIONS

International Search Report PCT/ISA/210 for International Application No. PCT/EP2012/073111 dated Aug. 2, 2013.

(Continued)

*Primary Examiner* — Thomas M Sember
(74) *Attorney, Agent, or Firm* — Harness, Dickey & Pierce, P.L.C.

(57) ABSTRACT

An indicator lamp is disclosed, in particular for an electromechanical command device. The indicator lamp includes a housing and a light source, which is arranged in the housing and emits light when supplied with energy. Furthermore, a lens arrangement is provided, including a first lens unit, which is arranged in the propagation direction of the light emitted by the light source and is built such that light beams emitted by the light source exit substantially parallel from a side of the first lens unit that faces away from the light source. The lens arrangement includes a second lens, which is arranged on the side of the first lens unit that faces away from the light source and is built such that some of the light beams exiting from the first lens unit are directed with respect to the propagation direction towards a transparent side surface of the housing.

17 Claims, 2 Drawing Sheets

(51) Int. Cl.
*F21V 13/04* (2006.01)
*F21W 111/00* (2006.01)

(56) References Cited

U.S. PATENT DOCUMENTS

| | | | |
|---|---|---|---|
| 4,583,151 | A | 4/1986 | Nagel |
| 4,758,701 | A | 7/1988 | Nagel |
| 2004/0004836 | A1 | 1/2004 | Dubuc |
| 2009/0279292 | A1 | 11/2009 | Vinkenvleugel |
| 2012/0281419 | A1 | 11/2012 | Roll |

FOREIGN PATENT DOCUMENTS

| | | | |
|---|---|---|---|
| WO | WO 2009130055 | A1 | 10/2009 |
| WO | WO 2011032997 | A2 | 3/2011 |

OTHER PUBLICATIONS

Written Opinion of the International Searching Authority PCT/ISA/237 for International Application No. PCT/EP2012/073111 dated Aug. 2, 2013.

* cited by examiner

INDICATOR LAMP

PRIORITY STATEMENT

This application is the national phase under 35 U.S.C. §371 of PCT International Application No. PCT/EP2012/073111 which has an International filing date of Nov. 20, 2012, which designated the United States of America, the entire contents of which are hereby incorporated herein by reference.

FIELD

At least one embodiment of the invention generally relates to an indicator lamp which, in particular, is a constituent part of an electromechanical command device.

BACKGROUND

Indicator lamps are used for the optical signaling of a state of a device in which the indicator lamps are incorporated. For signaling that can be detected simply by an operator, the indicator lamps must have uniform and bright illumination from the front as far as a defined viewing angle, e.g. 60° with respect to a longitudinal axis of the indicator lamp.

For this purpose, indicator lamps are implemented, for example, with a diffuser, with which uniform illumination can be achieved over the (entire) surface of the indicator lamp. However, the provision of a diffuser, which is arranged between a light source and a transparent, frequently colored, covering, generally entails a loss of brightness. Omitting the diffuser certainly ensures a higher brightness but entails non-uniform illumination of the covering.

In order to permit a uniform brightness over the viewing area with, at the same time, a high luminous power, U.S. Pat. No. 4,758,701 proposes the use of two Fresnel lenses matched to each other between the light source and a covering. By way of the lens arrangement, the light emitted by the light source can emerge substantially in parallel from the covering.

SUMMARY

At least one embodiment of the present invention is directed to an indicator lamp which, in particular, can be a constituent part of an electromechanical command device, and which is further improved in terms of construction andor function.

At least one embodiment of the present invention is directed to an indicator lamp and at least one embodiment is directed to an electromechanical command device. Advantageous refinements can be gathered from the dependent patent claims.

An indicator lamp, in particular for an electromechanical command device, is proposed in at least one embodiment. The indicator lamp comprises a housing and a light source arranged in the housing, which emits light when supplied with energy. Furthermore, a lens arrangement is provided, comprising a first lens unit, which is arranged in the propagation direction of the light emitted by the light source and is of such a nature that light beams emitted by the light source emerge substantially in parallel from a side of the first lens unit that faces away from the light source. The side of the first lens unit that faces away from the light source constitutes an exit surface of the first lens unit. This exit surface extends substantially perpendicular to a longitudinal axis of the indicator lamp. The exit surface of the first lens unit can have a continuous or else a non-continuous course in cross section.

In particular, the exit surface can comprise a multiplicity of non-continuous partial surfaces.

BRIEF DESCRIPTION OF THE DRAWINGS

The invention will be explained in more detail below by using an example embodiment in the drawing, in which.

In the figures, the same elements are provided with the same designations.

DETAILED DESCRIPTION OF THE EXAMPLE EMBODIMENTS

Figure 1:
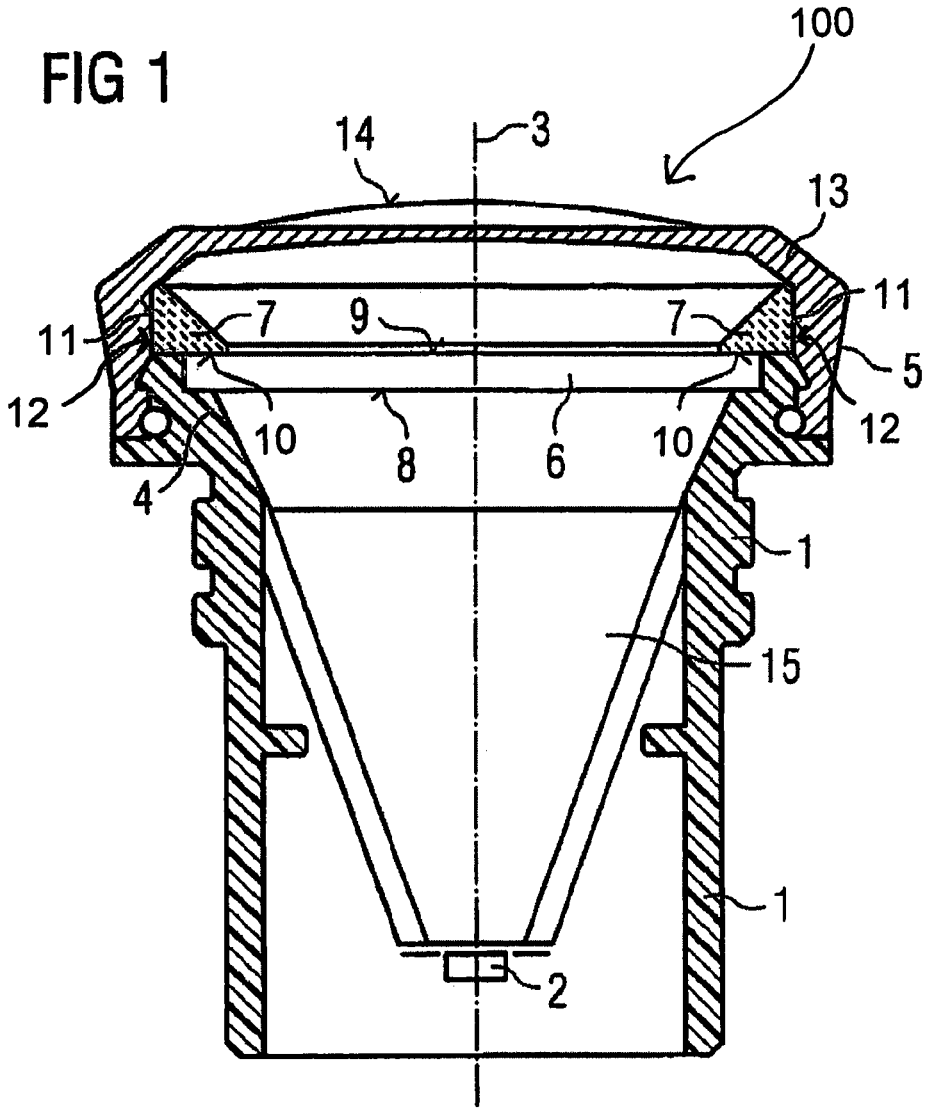
FIG. 1 shows a cross-sectional illustration of an indicator lamp according to an embodiment of the invention.

According to at least one embodiment of the invention, the lens arrangement comprises a second lens, which is arranged on the side of the first lens unit that faces away from the light source and is of such a nature that some of the light beams emerging from the first lens unit are directed with respect to the parallel propagation direction toward a transparent side surface of the housing.

The proposed indicator lamp not only permits a uniform brightness over the viewing area with, at the same time, a high luminous power, but also illumination at the side surfaces thereof, so that the perceptibility of the illumination of the indicator lamp is provided even at a high viewing angle. If the indicator lamp is used in particular in safety-relevant systems, then this contributes to a higher safety level. Furthermore, the perceptibility of the illuminated indicator lamp is found to be better by a user. The advantages described can be achieved by using a conventional incandescent bulb or a light-emitting diode (LED).

The transparent side surface of the housing, through which some of the light beams are deflected, can be formed by a pot-shaped, for example colored, covering cap. In this case, the light beams deflected by the second lens pass through the side walls of the covering cap. The non-deflected light beams, on the other hand, pass through the base or top of the covering cap. The base or top forms a viewing area of the indicator lamp which, as is usual, is located substantially in a plane perpendicular to the longitudinal propagation direction of the light beams.

According to an expedient refinement, provision is made for the first lens unit to comprise at least one, in particular aspherical, Fresnel lens. The use of a Fresnel lens as first lens unit makes it possible, in a space-saving manner, for light beams emitted by the light source to emerge substantially in parallel from the side of the Fresnel lens that faces away from the light source. In particular, as a result it is possible to arrange the light source at a short distance from the first lens unit. If the space in the indicator lamp plays a subordinate role, the first lens unit can also be formed by a conventional lens with convex surface on the side facing away from the light source. As a result of the aspherical shape, the imaging errors caused in the case of spherical lenses can be reduced.

According to a further expedient refinement, the second lens is a prismatic ring, the entry surface of which at least partly overlaps the exit surface of the light beams from the first lens unit. An overlap of the entry surface of the prismatic ring with the exit surface of the first lens unit may be expedient for mechanical reasons. If as many light beams as possible emerging from the exit surface of the first lens unit are to be deflected to the side by the prismatic ring, then the entry surface can also overlap the exit surface of the first lens unit completely.

In a further refinement, the second lens reflects and deflects the light beams entering it completely. In particular, according to this refinement, the second lens does not need to be designed to reflect the light beams entering it. In cross section, the prismatic ring has the shape of a triangle, in particular an equilateral triangle, so that the light beams entering the entry surface of the prismatic ring are reflected approximately at right angles.

It is also expedient if the entry surface of the second lens and the exit surface of the first lens unit run parallel to each other. In particular, the entry surface of the second lens and the exit surface of the first lens unit can adjoin each other. This ensures that the light beams entering the prismatic ring are deflected in the desired manner. As a result of the entry surface of the second lens and the exit surface of the first lens unit adjoining each other, a compact indicator lamp can be created.

A further refinement of the indicator lamp proposed provides for an exit surface of the second lens to be arranged parallel to a transparent surface section of a transparent covering cap and in particular to adjoin the latter. Optionally, the covering cap can be colored. The object of the covering cap consists in providing mechanical protection for the lens arrangement. If the covering cap is colored, then a specific signal action can be caused by the choice of the color. As already explained above, the covering cap can have a pot-like shape. Here, the light beams deflected by the second lens pass through the side walls, while the non-deflected light beams pass through the base or cover.

According to a further refinement, the housing between the light source and the first lens unit comprises a light reflection element, which reflects light emitted by the light source andor light reflected by the first lens unit. The light reflection element permits more uniform and more even illumination of the indicator lamp when a viewer glances at the indicator lamp at an angle with respect to the longitudinal axis of the indicator lamp.

It is particularly expedient if, for this purpose, the light reflection element is formed from a light and diffusive material. It is particularly preferable if the light reflection element is formed from a white material. For instant, the light reflection element can consist of a colored plastic. As a result of the bright color and the reflective properties brought about as a result, the light reflection element assumes the function of a "secondary" light source with respect to an oblique viewing angle.

According to a further expedient refinement, the light reflection element widens conically from the light source toward the first lens unit. In this way, the light emitted by the light source and the light possibly reflected at the lens arrangement can be reflected in the desired way by the light reflection element in order to form the secondary light source.

At least one embodiment of the invention further creates an electromechanical command device which comprises a push-button or push switch having an indicator lamp of the type described above. As opposed to a passive indicator lamp, it makes it possible for an electromechanical command device to give a switching command actively as a result of the actuation thereof. For example, by way of the command device, a machine can be switched on or off or a specific function can be activated or deactivated. The construction of an electromechanical command device can be implemented in different ways and is of secondary importance for an embodiment of the present invention. An example structure of a command device can be gathered, for example, from the document U.S. Pat. No. 4,758,701 mentioned at the beginning.

FIG. 1 shows a cross-sectional illustration of an indicator lamp 100 according to the invention. The indicator lamp 100 comprises a cylindrical housing 1, in which a light source 2 is arranged. The light source 2 can be, for example, an incandescent bulb or a light-emitting diode. A longitudinal axis of the cylindrical housing 1 is identified by the designation 3. The light source 2 is located on the longitudinal axis 3. Light emitted by the light source 2 extends in a substantially longitudinal propagation direction in the direction of an outer end 4 of the housing 1.

A lens arrangement 5 is attached to the outer end 4 of the housing 1. A covering cap 13 is arranged on the side of the lens arrangement 5 facing away from the light source 2. The covering cap 13 has a pot-like shape and encloses the lens arrangement 5. The covering cap 13 is latched by its lateral flanks or its side surface 12 to the outer end 4 of the housing 1, possibly detachably. Via the latching means, the lens arrangement 5 can be fixed in the indicator lamp 100.

The covering cap 13 includes a transparent and optionally colored material. If appropriate, a colored plate can also be located between the lens arrangement 5 and a viewing area 14 of the then preferably non-colored covering cap 13, in order to achieve a desired signal effect according to the color.

The lens arrangement 5 comprises a first lens unit 6 and a second lens 7. The lens unit 6 can be formed by an individual lens or a plurality of lenses. An entry surface of the light beams of the lens unit 6 is identified by the designation 8. The light beams emerge via a light exit surface 9 on the side of the lens unit 6 that faces away from the light source 2. The nature of the lens unit 6 is such that light beams emitted by the light source 2 emerge substantially in parallel from the exit surface 9. In this way, the light beams emerging in point form from the light source 2 are projected into infinity.

Figure 3:
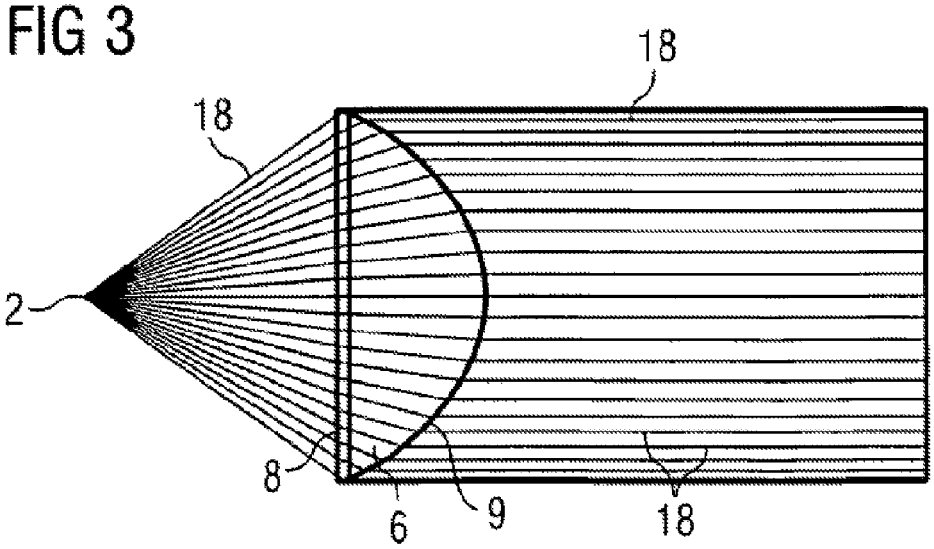
FIG. 3 shows a projection, known in principle, of the light beams emerging from a light source through a lens arrangement, through which the light beams are projected into infinity.

This is illustrated schematically in FIG. 3. Starting from the light source, not specifically illustrated (see designation 2 in FIG. 1), the light beams 18 emitted from the point-like light source extend in the direction of the lens unit 6 and enter the lens unit 6 through the entry surface 8. The light beams 18 are deflected at the entry surface (i.e. a first optical surface). A further deflection of the light beams 18 takes place following the traversing of the interior of the lens 6, at a light exit surface 9 (second optical surface). As a result of the shape of the lens unit 6 (which can be an individual lens or a plurality of lenses), the light beams 18 are deflected into infinity in the desired way. This means that the light beams 18 emerging from the light exit surface 9 run approximately parallel. This results in uniform illumination in a plane perpendicular to the longitudinal axis 3.

The same effect is achieved if the lens unit 6 is formed by an individual Fresnel lens. The use of a Fresnel lens makes it possible in particular to configure the distance between the light source 2 and the lens unit 6 to be very small. A further advantage of the Fresnel lens consists in the fact that, as opposed to the lens unit 6 illustrated in FIG. 3, the former is very flat, which means that compact indicator lamps 100 can be implemented. In the indicator lamp according to the invention illustrated in FIG. 1, a Fresnel lens is therefore preferably used as lens unit 6.

This ensures that the viewing area 14 of the covering cap 13 is illuminated uniformly. The uniform illumination in the indicator lamp 100 illustrated in FIG. 1 does not result only when the viewer is located on the longitudinal axis 3. Instead, the uniform illumination of the viewing area 14 is provided even when the viewing area 14 is viewed from an angle.

The uniform illumination is supported by a light reflection element 15 which is arranged between the light source 2 and the lens unit 6 and which, in cross section, has the shape of a cone. As can be seen from FIG. 1, the cone widens from the light source 2 toward the lens unit 6. The light reflection element 15 reflects light emitted by the light source 2 and/or light reflected by the lens unit 6. The light reflection element 15 preferably consists of a light and diffusive material. Particularly good reflective properties result when the light reflection element is white. For example, the light reflection element 15 is made of a white plastic.

The light reflection element 15 constitutes a "secondary" light source, in particular from oblique viewing angles. Here, an oblique viewing angle is understood to mean viewing the indicator lamp 100 from outside the longitudinal axis 3. It has been shown that the uniform illumination action of the viewing area 14 is maintained as far as a viewing angle 17 of 60° with respect to the longitudinal axis 3 or a parallel thereto. The light reflection element 15 could also be configured to be parabolic. However, for fabrication reasons, the shape of a cone is to be preferred.

By way of the second lens 7 of the lens arrangement 5, some of the light beams emerging from the first lens unit 6 can be deflected with respect to the longitudinal propagation direction, i.e. the longitudinal axis, toward the transparent side surface 12 of the covering cap 13. For this purpose, the second lens 7 is formed as a prismatic ring, while entry surface 10 at least partly overlaps the exit surface 9 of the light beams from the lens unit 6. Such a partial overlap is illustrated in FIG. 1. Here, the prismatic ring rests to some extent on an end face of the outer edge 4 of the housing 1.

In a modification of this refinement, the prismatic ring 7 could also be arranged on the lens unit 6 in such a way that the entry surface 10 of the lens 7 overlaps the exit surface 9 of the lens unit 6 completely.

As can readily be seen from the cross-sectional illustration of FIG. 1, the prismatic ring 7 has the shape of an approximately isosceles triangle in cross section. In this way, the lens 7 reflects the light beams entering the same completely and deflects said beams in the direction of the side surfaces 12 of the covering cap 13. At the same time, in the region of the prismatic lens 7, an exit of light in the region of the viewing area 14 is prevented. This results in a dark ring, which intensifies the perception of the light emerging laterally from the covering cap 13.

As a result, the illumination of the indicator lamp 100 can be perceived not only from the direction of the longitudinal axis and within the viewing angle described above but also in the event of completely lateral viewing of the indicator lamp 100.

Figure 2:
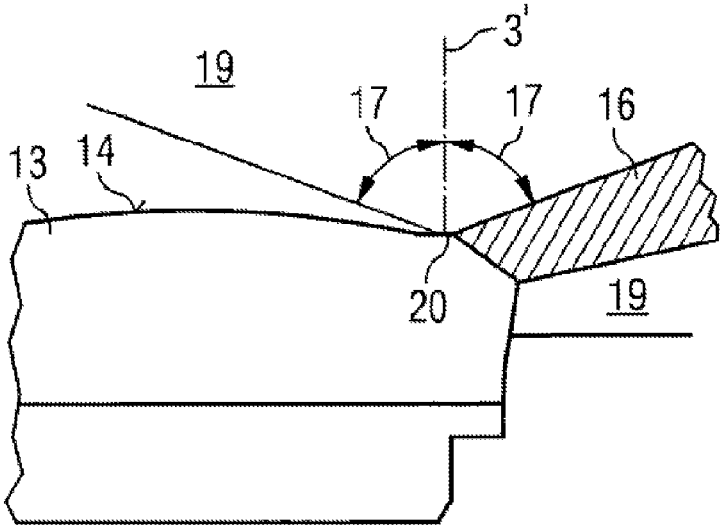
FIG. 2 shows an enlarged cross-sectional illustration of a detail of the indicator lamp illustrated in FIG. 1 in order to illustrate the light beams led out of the indicator lamp.

FIG. 2 shows, in an enlarged illustration, the illumination concept of the indicator lamp 100 in the region of the covering cap 13. As can readily be seen, the result in the region of the viewing area 14 is a clearly delimited circularly illuminated region. The transition from an illuminated region 19 of the viewing area 14 to a non-illuminated region, which can be perceived as a dark ring 16, is identified by the designation 20. The dark ring 16, which surrounds the circularly illuminated viewing area 14, is caused by the presence of the prismatic lens 7. In comparison, the flanks or side surfaces 12 of the covering cap 13 are in turn illuminated on account of the presence of the prismatic ring 7. This is identified by the designation 19.

Furthermore, in FIG. 2 the viewing angle 17 already mentioned is illustrated with respect to a parallel 3' to the longitudinal axis 3. If the parallel 3' runs through the boundary 20, then the viewing angle 17 toward the outer side marks the transition between the illuminated region 19 and the non-illuminated region 16.

LIST OF DESIGNATIONS

1 Housing
2 Light source
3 Longitudinal axis
3' Parallel to the longitudinal axis
4 Outer end of the housing
5 Lens arrangement
6 Lens unit
7 Second (prismatic) lens
8 Light entry surface of the lens unit 6
9 Light exit surface of the lens unit 6
10 Light entry surface of the prismatic lens 7
11 Light exit surface of the prismatic lens 7
12 Lateral flanks of the covering cap
13 Covering cap
14 Viewing area
15 Light reflection element
16 Dark ring
17 Viewing angle
18 Light beam
19 Illuminated region
20 Boundary between illuminated and non-illuminated regions
100 Indicator lamp

The invention claimed is:

1. An indicator lamp, comprising:
a housing;
a light source arranged in the housing, to emit light when supplied with energy; and
a lens arrangement including
a first lens unit, arranged in a propagation direction of the light emitted by the light source and configured such that light beams emitted by the light source emerge substantially in parallel from a side of the first lens unit that faces away from the light source, and
a second lens, arranged on a side of the first lens unit that faces away from the light source and configured such that some of the light beams emerging from the first lens unit are directed with respect to the parallel propagation direction toward a transparent side surface of the housing, wherein the second lens is a prismatic ring, an entry surface of which at least partly overlaps an exit surface of the light beams from the first lens unit.

2. The indicator lamp of claim 1, wherein the first lens unit includes at least one Fresnel lens.

3. The indicator lamp of claim 2, wherein the first lens unit includes at least one aspherical Fresnel lens.

4. The indicator lamp of claim 1, wherein the second lens reflects and deflects the light beams entering it completely.

5. The indicator lamp of claim 4, wherein the entry surface of the second lens and the exit surface of the first lens unit run parallel to each other.

6. The indicator lamp of claim 1, wherein the entry surface of the second lens and the exit surface of the first lens unit run parallel to each other.

7. The indicator lamp of claim 1, wherein an exit surface of the second lens is arranged parallel to a transparent surface section of a transparent covering cap.

8. The indicator lamp of claim 7, wherein the exit surface of the second lens is arranged parallel to the transparent surface section of a transparent and colored covering cap.

9. The indicator lamp of claim 8, wherein the exit surface of the second lens is arranged parallel to and adjoins the transparent surface section of a transparent and colored covering cap.

10. The indicator lamp of claim 1, wherein the housing between the light source and the first lens unit comprises a light reflection element, to reflect light at least one of emitted by the light source and light reflected by the first lens unit.

11. The indicator lamp of claim 10, wherein the light reflection element is formed from a light and diffusive material.

12. The indicator lamp of claim 11, wherein the light reflection element widens conically from the light source toward the first lens unit.

13. The indicator lamp of claim 10, wherein the light reflection element widens conically from the light source toward the first lens unit.

14. An electromechanical command device comprising:

a pushbutton, the pushbutton comprising the indicator lamp of claim 1.

15. The indicator lamp of claim 1, wherein the indicator lamp is for an electromechanical command device.

16. The indicator lamp of claim 1, wherein the entry surface of the second lens and the exit surface of the first lens unit run parallel to each other and adjoin each other.

17. An indicator lamp, comprising:

a housing;

a light source arranged in the housing, to emit light when supplied with energy; and a lens arrangement including a first lens unit, arranged in a propagation direction of the light emitted by the light source and configured such that light beams emitted by the light source emerge substantially in parallel from a side of the first lens unit that faces away from the light source, and a second lens, arranged on a side of the first lens unit that faces away from the light source and configured such that some of the light beams emerging from the first lens unit emerge substantially in parallel from the indicator lamp via a side of the first lens unit and some of the light beams are directed with respect to the parallel propagation direction toward a transparent side surface of the housing.

* * * * *